United States Patent [19]

Naito et al.

[11] Patent Number: 4,824,035

[45] Date of Patent: Apr. 25, 1989

[54] CAGE MILL

[75] Inventors: Sousuke Naito, Osaka; Hidekazu Takahashi, Tokyo; Shunzo Shimai, Togane; Toshio Watanabe, Osaka; Yasuji Otsuka, Tokyo, all of Japan

[73] Assignees: Toshiba Ceramics Co., Ltd.; Kansai Zyari Kabushiki-Kaisha; Otsuka Iron Works, Ltd., all of Japan

[21] Appl. No.: 160,017

[22] Filed: Feb. 24, 1988

[51] Int. Cl.[4] ..... B02C 7/04; B02C 13/20

[52] U.S. Cl. ..... 241/188 A; 241/196; 241/197; 241/290

[58] Field of Search ..... 241/188 R, 188 A, 195, 241/197, 196, 290

[56] References Cited

U.S. PATENT DOCUMENTS

| | | | |
|---|---|---|---|
| 211,316 | 1/1879 | Bennett | 241/188 A X |
| 2,211,570 | 8/1940 | Kennedy et al. | 241/188 A X |
| 3,503,561 | 3/1970 | Johnson | 241/197 X |
| 4,580,736 | 4/1986 | Takahashi et al. | 241/188 A |

*Primary Examiner*—Joseph M. Gorski

*Attorney, Agent, or Firm*—Ronald P. Kananen

[57] ABSTRACT

A cage mill includes a housing, a disc rotatably supported within the housing, a plurality of support shafts each fixed at one end to the disc so as to form a cage, a band fixed to the other end of each of the support shafts, a plurality of ceramic pins each having a through-hole in which one of the support shafts is placed so as to support one of the ceramic pins, and a plurality of nuts each engaging with a male screw portion of each end of the support shafts for releasably fixing the support shafts and the ceramic pins to the disc and the band. The support shafts and loosely placed in the ceramic pins, respectively, so that the latter can be turned around the former when the nuts are released.

10 Claims, 2 Drawing Sheets

CAGE MILL

BACKGROUND OF THE INVENTION

This invention relates to a cage mill which can crush hard materials such as stone.

A conventional cage mill has a plurality of cage type rotors each including a plurality of ceramic pins arranged in such a way that they rotate in opposite directions while the hard materials are supplied into a central space of the cage mill whereby the hard materials can be crushed. One example of such a cage mill is disclosed in U.S. Pat. No. 4,580,736.

In such a conventional cage mill, the ceramic pins are respectively supported by support shafts. An adhesive is provided between each of the support shafts and the ceramic pins supported thereby so that the ceramic pins are fixed to the support shafts. Thus, if some part of a certain ceramic pin is worn down, both the worn ceramic pin and the support shaft supporting it must be replaced with a new ceramic pin and a new support shaft. Such a replacement takes a long time and is expensive since the support shafts and their related members must be disassembled.

SUMMARY OF THE INVENTION

The object of this invention is to provide a cage mill in which a ceramic pin can be easily repaired at a low cost and operate for a long period of time.

According to this invention, a cage mill includes a housing, a disc rotatably supported within the housing, a plurality of support shafts each fixed at one end to the disc so as to form a cage, a band fixed to the other end of each of the support shafts, a plurality of ceramic pins each having a through-hole in which one of the support shafts is placed so as to support one of the ceramic pins, and means for releasably fixing the support shafts and the ceramic pins to the disc and the band. The support shafts are loosely placed in the respective ceramic pins, so that the latter can be turned around the former when the fixing means is in a released condition.

The fixing means preferably includes: (a) a plurality of nuts, each engaging with a male screw portion of each end of the support shafts, for releasably fixing the ceramic pins to the band and the disc; (b) a spacer and a resilient member between one end of each of the support shafts and the disc, as well as a spacer and a resilient member between the other end of each of the support shafts and the band; and (c) a first base plate to which a plurality of ceramic linings are fixed, the first base plate being placed between the band and the resilient member and a second base plate to which a plurality of ceramic linings are fixed, the second base plate being placed between the disc and the resilient member.

BRIEF DESCRIPTION OF THE EMBODIMENTS

Figure 2:
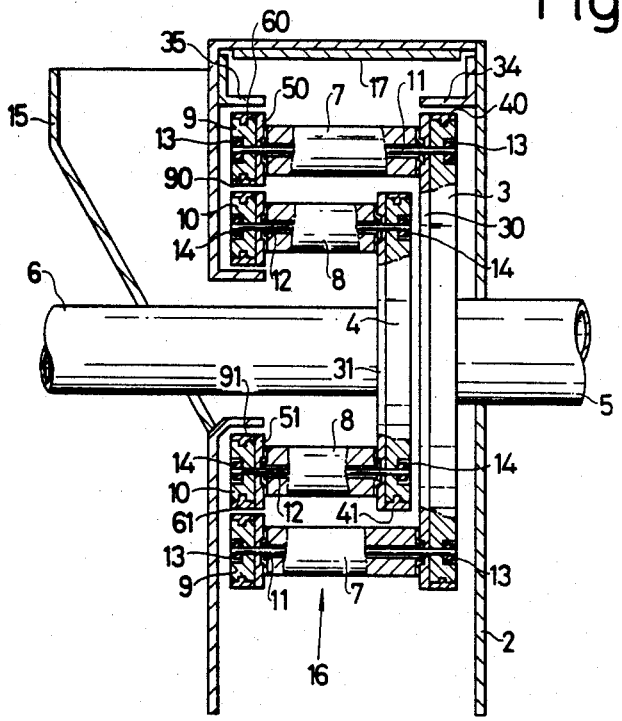
FIG. 2 is a schematic sectional view showing a mechanism in a housing of the cage mill shown in FIG. 1.
Figure 3:
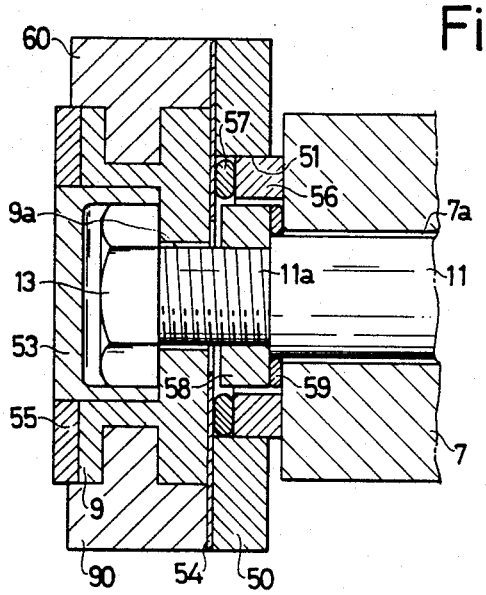
FIG. 3 is a sectional view showing ceramic linings and their related parts of the cage mill.

Referring to FIGS. 2 and 3, plural ceramic pins 7 made of a ceramic material are arranged in a cage shape. Each of the ceramic pins 7 has a through-hole 7*a* along its axis in which a support shaft 11 is loosely placed with a minor clearance. The support shaft 11 has at both ends a male screw portion 11*a*. A nut 13 is screwed with the male screw portion 11*a* at each end of the support shafts 11 so that the ends of the support shafts 11 are releasably fixed to a disc 3 and a ring-shaped band 9.

As shown in FIG. 3, a base plate 54, a resilient member, such as a rubber ring 57, and a spacer 56 are disposed between the band 9 and one end of each of the ceramic pins 7 as well as between the disc 3 and the other end of each of the ceramic pins. When the nuts 13 are screwed with the male screw portions 11*a*, the disc 3 and the band 9 are forced to move close to the ends of the ceramic pins 7 against the resilience of the rubber ring 57 whereby the support shafts 11 and the ceramic pins 7 can be fixed to the band 9 and the disc 3 as a cage unit.

Figure 4:
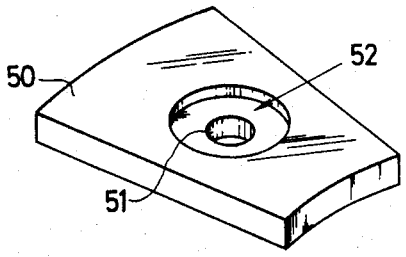
FIG. 4 is a perspective view showing a ceramic lining for a band.

A plurality of ceramic linings 50 are closely fixed to the base plate 54 by means of an adhesive in a continuous mode so as to form a ring. A hole 51 is formed in each of the ceramic linings 50 as shown in FIG. 4. The rubber ring 57 and the spacer 56 are arranged in the hole 51. A nut 58 is placed within the spacer 56 and engages with the male screw portion 11*a* of each of the support shafts 11 so as to function as a spacer. A rubber ring 59 is disposed between the nut 58 and one end of the ceramic pin 7.

Ceramic linings 40, 60 cover the periphery of the disc 3 and the band 9 in a fixed condition. Each of the ceramic linings 40, 60 has a portion which is complementary to portions of the disk and the band so as to be attached to or detached from the corresponding portions of the disc 3 and the band 9.

DETAILED DESCRIPTION OF THE EMBODIMENTS

Figure 1:
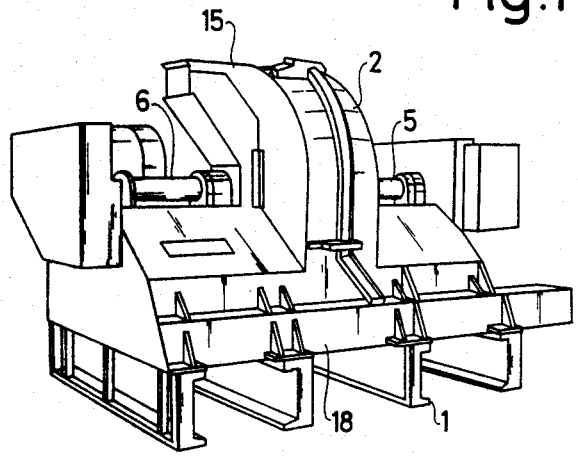
FIG. 1 is a schematic perspective view showing a cage mill according to an embodiment of this invention.

FIG. 1 shows a cage mill according to this invention. The housing 2 is fixed through a frame 18 to a base 1.

As shown in FIG. 2, two discs 3, 4 are concentrically arranged within the housing 2 in parallel to each other. A central portion of the disc 3 is joined to one end of a driving shaft 5. A central portion of the disc 4 is joined to another driving shaft 6. The driving shafts 5, 6 are coaxially supported by bearings (not shown) and connected to respective motors (not shown), in such a way that they can rotate in opposite directions.

Plurality of ceramic pins 7 are releasably fixed to the disc 3 and the ring-shaped band 9 at regular intervals so as to form a large cage type rotor, whereas plural ceramic pins 8 are releasably fixed to the disc 4 and the ring-shaped band 10 at regular intervals so as to form a small cage type rotor. Each of the ceramic pins 7, 8 has a through-hole along its axis in which a support shaft 11 or 12 is loosely placed with a clearance. The support shafts 11, 12 are fastened to the discs 3, 4 by means of nuts 13, 14, respectively. Also, the shafts 11, 12 are fastened to the bands 9, 10 by means of nuts 13, 14, respectively.

Although in the shown embodiment two cages are employed, this invention can be applied to a cage mill having a single cage, four cages, or six cages. Generally speaking, as the desired size of the final crushed product becomes smaller, the required number of cages increases. Also, a variety of product gradations can be easily altered by changing the speed of the cage mill.

The housing 2 is substantially cylindrical in shape although it is not limited only to such a shape.

In operation, the hard materials are inserted through an inlet of a hopper 15 into a central portion of the smallest cage near the driving shaft 6. The hard materials are first crushed by the ceramic pins 8 and move outwardly. Such crushed materials are further crushed by the ceramic pins 7. Finally, the materials move outwardly from the ceramic pins 7 so that they are crushed by braker plates 17 fixed on an inner surface of the housing 2 thereby to become the final crushed product. Thereafter the final crushed product falls by gravity through a lower exit 16 of the housing 2.

Plurality of covers 34, 35 are fixed to an inner surface of the housing 2.

The large cage will be explained in detail as a typical example although this invention can be equally applied to both the small cage and the large cage.

Each support shaft 11 is loosely placed in the ceramic pin 7, for example, with a clearance of about 1 mm. No adhesive is provided in the clearance. Thus, the ceramic pin 7 can be turned about the support shaft 11 if the nuts 13, 58 are released.

A plurality of portions are closely or continuously formed on the inside of the disc 3. A plurality of ceramic linings 30 each having a portion which is complementary to and fixed to the corresponding portions of the disc 3 so as to cover the inside of the disc 3. The ceramic linings 30, each having a fan or trapezoidal shape, are close to each other so that substantially no clearance is formed between the ceramic linings 30. One end of the support shaft 11 penetrates through a hole of each ceramic lining 30.

Figure 5:
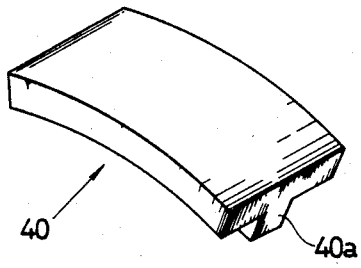
FIG. 5 is a perspective view showing another ceramic lining.

A plurality of ceramic linings 40 as shown in FIG. 5 are closely or continuously fixed to the periphery of the disc 3 to cover it. Each of the ceramic linings 40 has a portion 40*a* which is set into a portion of the disc 3.

A plurality of ceramic linings 60, 90 similar to the ceramic linings 40 are closely or continuously fixed to the outer and inner peripheral portions of the band 9 to cover it.

As shown in FIG. 4, each ceramic lining 50 has a fan or trapezoidal shape. A hole 51 is formed in a central portion of the ceramic lining 50. The support shaft 11 penetrates slightly through the hole 51. A step portion 52 is formed along the hole 51.

One end of the support shaft 11 is inserted into the hole of the disc 3 and engages at its male screw portion 11*a* the nut 13 so as to releasably fix the ceramic pin 7 to the disc 3, whereas the other end of the support shaft 11 is inserted into the hole 9*a* of the band 9 and engages at its male screw portion 11*a* the nut 13 so as to releasably fix the ceramic pin 7 to the band 9. The nut 9 is positioned in the hole 9*a* of the band 9.

As shown in FIG. 2, the disc 4 is covered by a plurality of ceramic linings 31 similar to the ceramic linings 30 as in the disc 3. The ceramic linings 31 of a fan or trapezoidal shape are closely or continuously arranged on the disc 4 in a complementary relation. A plurality of ceramic linings 41 similar to the ceramic linings 40 are closely fixed to the outer periphery of the disc 4 in a complementary relation.

The band 10 is covered by a plurality of ceramic linings 51 similar to the ceramic linings 50 as in the band 9. Many ceramic linings 61, 91 similar to the ceramic linings 40 are closely fixed to the inner and outer peripheral portions of the band 10 as in the band 9.

The ceramic linings, each having a convex portion as shown in FIG. 5, can have good durability and excellent strength and be easily made and efficiently attached to or detached from the discs and the bands.

Adhesives for fixing the ceramic linings to the bands and the discs may be an epoxy resin or any other binder. The ceramic linings are preferably made of alumina ceramics or silicon nitride.

Referring to FIG. 3, the relationship between the support shaft 11 and the band 9 will be explained in detail as a typical example.

A plurality of ceramic linings 50 shown in FIG. 4 are closely fixed in a ring shape to the band 9 through a ring-shaped metal base plate 54 by means of an adhesive. Each of the ceramic linings 50 has the hole 51. The male screw portion 11*a* of each support shaft 11 is inserted into the hole 51 of each ceramic lining and the hole 9*a* of the band 9. The ceramic spacer 56 is set in the hole 51 of the ceramic lining 50 in such a manner that an outer surface of the ceramic spacer 56 partly contacts an inner surface of the hole 51. One end of the spacer 56 contacts one end of the ceramic pin 7, whereas a resilient member, such as a rubber ring 57, is disposed between the other end of the ceramic pin 7 and the base plate 54. By fastening the nut 13 to the male screw portion 11*a* of the support shaft 11, the base plate 54, the rubber ring 57 and the spacer 56 are pressed by and between the ceramic pin 7 and the band 9 against the resilience of the rubber ring 57 so that they are fixed to each other.

A metal nut 58 engages with the male screw portion 11*a* of the support shaft 11 and functions as a spacer. A rubber ring 59 is detachably disposed between one end of the ceramic pin 7 and the nut 58.

A plurality of ceramic linings 55 similar to the ceramic linings 50, are closely fixed to the outside of the band 9. A cap 53 is detachably pressure-fitted in the hole 9*a* of the band 9.

Figure 6:
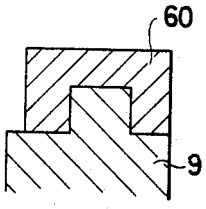
FIG. 6 is a sectional view showing a band and its related member according to another embodiment of this invention.

FIG. 6 shows a modified ceramic lining 60 having a portion which is attached to a corresponding portion of a modified band 9.

According to this invention, no adhesive is provided between the ceramic pin 7 and the support shaft 11, and the support shaft 11 is loosely placed in the ceramic pin 7 so that there is some clearance between them. Therefore, the ceramic pin 7 can be turned in a desired direction around the support shaft 11 when the nuts 13 are released. For example, if a certain portion of the ceramic pin and in particular, a front portion thereof is remarkably worn down, after the nuts 13 are released, the ceramic pin 7 is turned until non-worn portion of the ceramic pin 7 moves to a front position where a majority of the hard materials are crushed by the ceramic pin 7. At that time, it is not necessary to disassemble the support shaft 11.

If the ceramic pin 7 is gradually turned whenever a front portion of the ceramic pin 7 is worn down, the ceramic pin 7 can be repeatedly reused so that its effective life time becomes greater.

Even if a certain old ceramic pin 7 is replaced with a new one, the old support shaft supporting it can be reused. Thus, the maintenance is easy and the repair cost is low.

If the resilient member, such as the rubber ring 57 and the spacer 56, are used in combination, it is easy to assemble and disassemble the band 9, the ceramic pins 7, the support shafts 11 and the disc 3. The fastening force of the nuts 13 can be adjusted in such a manner that the ceramic pins 7 can automatically turn around the support shaft 11, since if the resilience of the rubber ring 57 is weak while the cage mill operates.

Since the resilient member 57 has a heat resistance, the cage mill can operate at a high temperature because the heat expansion of the ceramic pin 7, the support shaft 11, the band 9, the disc 3 and other can be absorbed by the resilient member 57.

If the base plate 54 is placed between the resilient member 57 and the band 9, the base plate 54 receives all of the force for fixing the ceramic pin 7 and the centrifugal force occuring in rotation.

If the base plate 54 directly contacts the band 9 and the ceramic linings 60, 90 as shown in FIG. 3, no shearing force is exerted on the ceramic linings 60, 90 so as to obtain a high strength.

If an outer surface of the spacer 56 contacts an inner surface of each of the ceramic linings 50, the crushed product cannot enter between them so that the rubber ring 57 and others are not damaged thereby to be used for a long period of time.

If the whole area of the bands and the discs are covered by the ceramic linings, their durability can be increased.

We claim:

1. A cage mill comprising:

a housing;

a disc rotatably supported within the housing;

a plurality of support shafts each fixed at one end to the disc so as to form a cage;

a band fixed to the other end of each of the support shafts;

a plurality of ceramic pins each having a through-hole;

a plurality of nuts for releasably fixing respective ones of the support shafts to the disc and the band;

the support shafts being loosely placed in the through-holes of the respective ceramic pins;

each of the support shafts having at an end thereof a small-diameter portion;

a plurality of press members each of which is set at the small-diameter portion of a respective one of the support shafts;

a plurality of ceramic spacers each contacting a respective end of each of the ceramic pins;

the ceramic spacers being positioned outside the press members, respectively;

a plurality of first rings made of a resilient material, each one of which is placed between a respective one of the press members and one of the ceramic pins inside the ceramic spacers;

a plurality of second rings made of a resilient material, each one of which is placed between a respective one of the ceramic spacers and the band; and a plurality of ceramic linings fixed to the band, each one of which is positioned outside a respective one of the ceramic spacers so as to cover the second rings;

whereby, when the nuts are in a fixing condition, the first rings are pressed by the press members and the ceramic pins while the second rings are pressed by the ceramic spacers and the band.

2. The cage mill of claim 1, wherein the small-diameter portion is a male screw portion for engaging a respective one of the nuts.

3. The cage mill of claim 2, wherein the press member is a nut for engaging the male screw portion.

4. The cage mill of claim 1, further comprising a plurality of base plates, each being fixed to the band, the ceramic linings being fixed through a respective one of the base plates to the band.

5. The cage mill of claim 4, wherein each base plate is placed directly on the band and the ceramic linings.

6. The cage mill of claim 4 wherein each of the base plates is between the band and a respective one of the second rings.

7. The cage mill of claim 1, further comprising a plurality of ceramic members each being fixed to the band in a complementary relation so as to cover the band.

8. The cage mill of claim 1, wherein at least the second rings have a heat resistance so that the heat expansion of at least the pins, the support shafts, and the band can be absorbed by at least the second rings.

9. The cage mill of claim 1, wherein the ceramic spacers are formed in a ring shape and contact the ceramic linings so as to cover the second rings.

10. The cage mill of claim 9 wherein the second rings have a relatively weak resilience so that the fastening force of the respective nuts can be adjusted so that respective ones of the ceramic pins can automatically turn around respective ones of the support shafts when the cage mill operates.

* * * * *